United States Patent [19]

Neufeldt

[11] 4,385,412

[45] May 31, 1983

[54] ATTACHMENT FOR REMOVING GLUED-ON CARPET PADDING

[76] Inventor: Emerson W. Neufeldt, 110 W. 2nd St., Buhler, Kans. 67522

[21] Appl. No.: 285,875

[22] Filed: Jul. 22, 1981

[51] Int. Cl.[3] ..... A47L 13/02

[52] U.S. Cl. ..... 15/236 C; 15/93 R; 29/81 G; 29/81 J; 51/177; 125/5

[58] Field of Search ..... 15/236 C, 93 R; 29/81 G, 81 J; 125/5; 51/177

[56] References Cited

U.S. PATENT DOCUMENTS

| | | | |
|---|---|---|---|
| 1,012,926 | 12/1911 | Smith et al. | 125/5 |
| 2,504,643 | 4/1950 | Burgoon | 15/93 R |
| 3,678,532 | 7/1972 | Boyd | 15/236 NO |
| 4,148,110 | 4/1979 | Moen | 15/236 C X |
| 4,185,350 | 1/1980 | Fish | 15/236 C |

*Primary Examiner*—Chris K. Moore

*Attorney, Agent, or Firm*—Edwin H. Crabtree

[57] ABSTRACT

An attachment adapted for mounting on a conventional rotary floor surfacing machine such as a buffer, sander, polisher or the like. The attachment having a plurality of individual wire blades that provide a brush like cutting edge for engaging and quickly removing old rubber padding attached to a floor.

4 Claims, 6 Drawing Figures

ATTACHMENT FOR REMOVING GLUED-ON CARPET PADDING

BACKGROUND OF THE INVENTION

This invention relates to an attachment for removing glued-on carpet padding and more particularly, but not by way of limitation to an attachment for mounting on rotary floor surfacing machines that can provide the necessary rotational movement so the attachment can be used for engaging and removing carpet padding.

Heretofore, it has been extremely difficult and time consuming to remove carpet padding which is glued on to concrete or wooden floors. This padding has been removed by hand using scrapers, knives and various types of wire brush equipment. The subject invention eliminates the above troublesome and time consuming job.

The following patents disclose different types of floor surfacing machines, polishing, scraping and scrubbing equipment. None of the patents disclose the unique structure and advantages of the subject invention as described herein.

The patents are:

U.S. Pat. No. 3,527,001 to Kleemier, et al.
U.S. Pat. No. 1,770,549 to Peterson
U.S. Pat. No. 3,605,347 to Barry
U.S. Pat. No. 1,650,035 to Peterson
U.S. Pat. No. 1,392,543 to Watrous
U.S. Pat. No. 4,122,576 to Bevington et al.
U.S. Pat. No. 2,480,739 to Johnson
U.S. Pat. No. 3,428,984 to Collier

SUMMARY OF THE INVENTION

The attachment for removing glued-on carpet padding is simple in design, rugged in construction and may be adapted for mounting on various types of rotating floor buffer sanders, sweepers, polishing equipment and the like.

The attachment includes a plurality of wire blades mounted radially on the bottom of the attachment which quickly and efficiently remove old carpet padding glued to a wood or concrete floor.

The attachment is inexpensive and greatly reduces the cost of time and labor for removing the carpet padding and eliminates hand removal of the glued-on padding.

The attachment is adapted for mounting on a conventional rotary floor surfacing machine or the like. It includes a circular top plate having an adapter mounted on the top thereof for releasably securing the attachment to the machine. A circular bottom plate having radial grooves in the top thereof is releasably mounted to the bottom of the top plate. A plurality of u-shaped wire blades are received in the grooves in the bottom plate. The grooves include a plurality of holes therethrough. The arms of the blades are received through the holes and extend downwardly therefrom for engaging the padding as the attachment is rotated by the machine.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
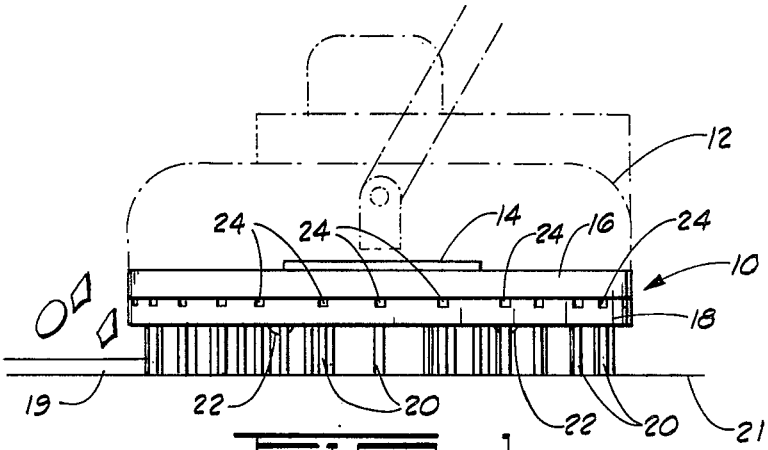
FIG. 1 is a side view of the attachment mounted on the bottom of a conventional floor surfacing machine shown in dotted lines.

In FIG. 1 is a side view of the attachment for mounting on a conventional rotary floor surfacing machine is shown and designated by general reference numeral 10. The attachment 10 is releasably secured to a rotary floor surfacing machine 12 by an adapter 14. It should be appreciated that while the machine 12, shown in dotted lines, is illustrated, any type of rotating equipment used for sweeping, sanding, finishing, polishing floors and the like can be used equally well and the adapter 14 designed accordingly for attachment to the rotary piece of equipment.

The attachment 10 includes a circular top plate 16, a circular bottom plate 18, and a plurality of brush-like u-shaped wire blades 20. The blades 20 may be made of butcher wire or any other similar wire material. The blades 20 engage a carpet padding 19 glued onto a floor 21. The circular bottom plate 18 is releasably attached to the bottom of the top plate 16 by nuts 22 attached to screws 23 shown in FIG. 2 and FIG. 4.

The bottom plate 18 further includes a plurality of radial grooves 24 extending outwardly from the open center 26 of the bottom plate 18. The open center 26 can be seen in FIG. 3.

Figure 2:
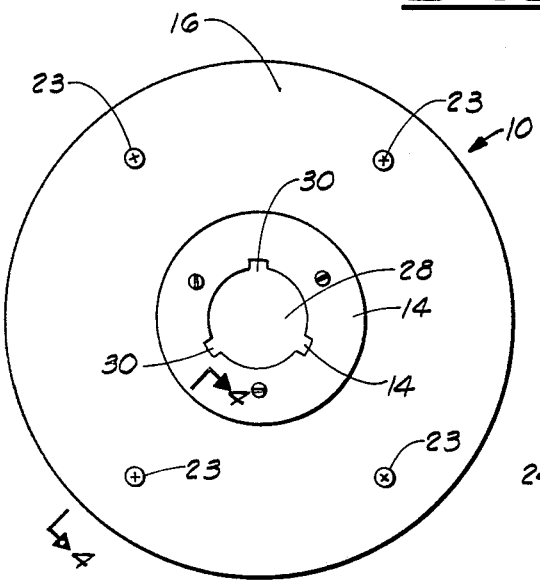
FIG. 2 is a top view of the attachment.

In FIG. 2 a top view of the attachment 10 can be seen removed from the machine 12. In this view, the adapter 14 can be seen with an opening 28 through the center thereof and having ears 30 which are used for engaging the bottom of the machine 12.

Figure 3:
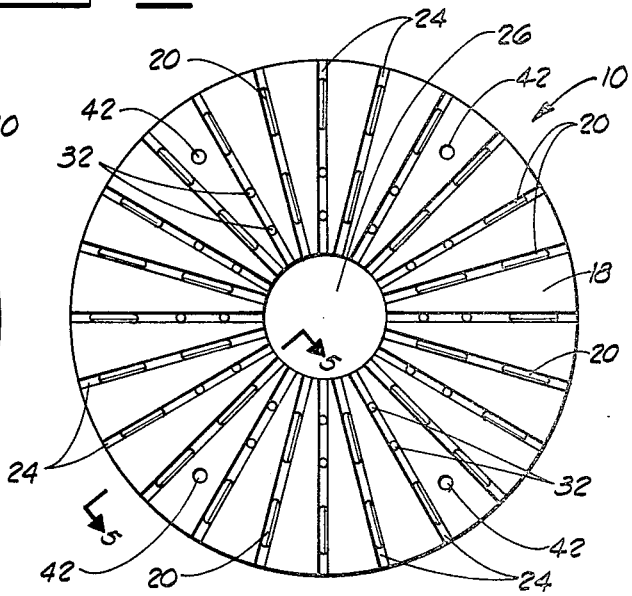
FIG. 3 is a top view of the circular bottom plate.

In FIG. 3 a top view of the bottom plate 18 is seen with the top plate 16 removed. In this figure, the radial grooves 24 can be seen equally spaced around the circumference of the bottom plate 18. The depth of each groove 24 is sufficient so that when the u-shaped blades 20 are received through a plurality of holes 32 in the groove 24, the top of the blades 20 are flush with the top of the bottom plate 18. By referring to FIG. 6, it can be seen that the blades 20 actually include a plurality of the u-shaped blades 20, in this case four blades 20 stacked on on top of the other. The blades 20 include a center portion 36 integrally attached to a pair of downwardly extending arms 38 and 40. The arms 38 and 40 are received through the holes 32 and extend downwardly through the width of the plate 18 and from the bottom of the plate 18 for engaging the glued-on carpet padding 19.

It should be noted that a pair of blades 20 are received in each groove 24 except for alternate grooves having a blade removed closest to the center of the bottom plate 18. By removing these blades 20, the padding 19 is prevented from balling up or accumulating around the inner circumference of the attachment 10 as it removes the padding 19 from the floor 21. Also seen in this view are holes 42 used for receiving the nuts 22 and screws 23.

Figure 4:
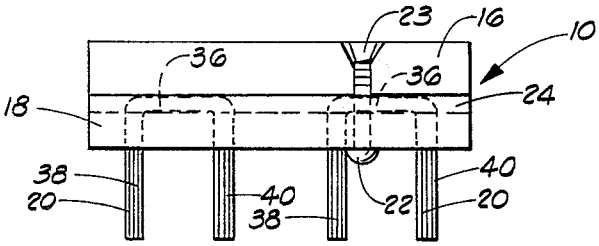
FIG. 4 is a sectional view taken along lines 4—4 shown in FIG. 2.

In FIG. 4 a sectional view taken along lines 4—4 in FIG. 2 is shown. In this view, the blades 20 can be seen with the upper portion of the arms 38 and 40 and the center portion 36 received in the groove 24. By securing with the nuts 22 and screws 23 the top plate 16 is flush with the top of the bottom plate 18 with the blades 20 in the grooves 24 secured therebetween. When it is desired to remove the blades 20 because of wear, the top plate 16 is quickly removed from the bottom plate 18 and the blades 20 are pushed upwardly from the holes 32 and the grooves 24 so that they may be replaced.

Figure 5:
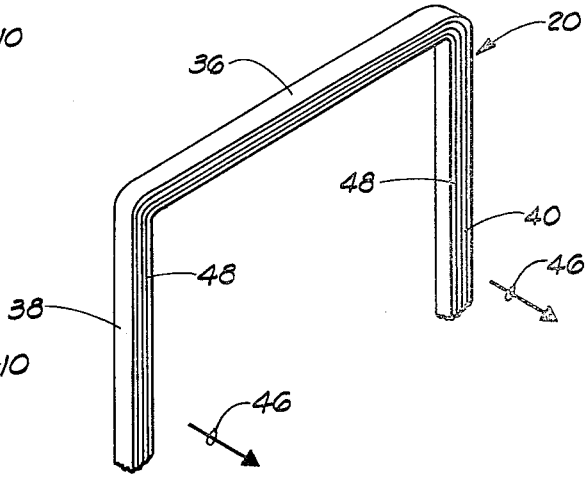
FIG. 5 is a sectional view taken along lines 5—5 shown in FIG. 3.

In FIG. 5 a cross section of the bottom plate 18 is shown taken along line 5—5 shown in FIG. 3. Again, it can be seen that the center portion 36 received in the groove 24 is flush with the top of the bottom plate 18 so that the blades 20 are secured therein. Typically the width of the bottom plate 18 and top plate 16 are in a range of three-quarters of an inch with the lower portion of the blades 20 extending downwardly from the bottom of the bottom plate 18 in a range of one inch.

Figure 6:
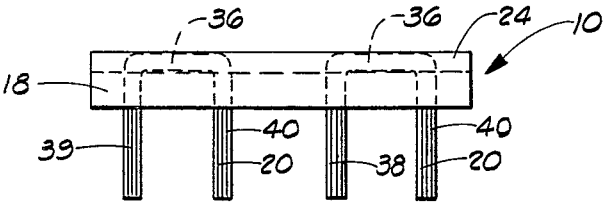
FIG. 6 is a perspective view of one of the u-shaped wire blades wherein a plurality of the blades are stacked one on top of the other.

In FIG. 6 a perspective view of one of the blades 20 is illustrated. To provide a brush-like configuration of the blades 20 a plurality of the blades 20 are stacked one on top of the other. In this case there are four blades 20 stacked one on top of the other to provide a brush-like design and increase the overall strength of the blade 20. In this figure, arrows 46 represent the direction of the rotating movement of the machine 12. The width of the arms 38 and 40 are parallel to the direction indicated by arrows 46 so that edges 48 of the blades 20 engage the padding 19 thereby providing the necessary cutting action for removing the padding 19.

Through the unique combination of the top plate 16 and bottom plate 18 with the grooves 24 therein for receiving the u-shaped wire blades an efficient and inexpensive attachment is provided for conventional rotating floor surfacing equipment used in removing glued-on carpet padding.

Changes may be made in the construction and arrangement of the parts or elements of the embodiments as described herein without departing from the spirit or scope of the invention defined in the following claims.

What is claimed is:

1. An attachment adapted for mounting on a conventional rotary floor surfacing machine or the like, the attachment used for removing carpet padding glued to the floor, the attachment comprising:

a circular top plate;

an adapter mounted on the top plate for releasably securing the attachment to the machine;

a circular bottom plate releasably mounted on the bottom of the top plate, the circular bottom plate having a plurality of radial grooves in the top thereof, the grooves having a plurality of parallel holes extending downwardly through the width of the bottom plate; and a plurality of u-shaped wire blades, each blade having a center portion integrally attached to two downwardly extending arms, the center portion of the blade received inside the groove in the bottom plate, the downwardly extending arms received through the holes in the groove and downwardly from the bottom of the bottom plate for engaging the carpet padding glued to the floor.

2. The attachment as described in claim 1, wherein the u-shaped blades include more than one blade stacked one on top of the other to increase the overall strength of the arms engaging the carpet padding and providing a brush-like cutting edge.

3. The attachment as described in claim 1, wherein the bottom plate is releasably mounted to the top plate so the bottom plate can be removed and the u-shaped wire blades removed when they become worn.

4. An attachment adapted for mounting on a conventional rotary floor surfacing machine or the like, the attachment used for removing carpet padding glued to the floor, the attachment comprising:

a circular top plate;

an adapter mounted on the top plate for releasably securing the attachment to the machine;

a circular bottom plate releasably mounted on the bottom of the top plate, the circular bottom plate having a plurality of radial grooves in the top thereof, the grooves having a plurality of parallel holes extending downwardly through the width of the bottom plate; and a plurality of u-shaped wire blades, each blade having a center portion integrally attached to two downwardly extending arms, the center portion of the blade received inside the groove in the bottom plate, the downwardly extending arms received through the holes in the groove and downwardly from the bottom of the bottom plate, the width of the arms of the blades are positioned so they are parallel to the direction of the travel of the machine so the edges of the arms engage the carpet padding.

* * * * *